US008800719B2

(12) United States Patent
Auston et al.

(10) Patent No.: US 8,800,719 B2
(45) Date of Patent: Aug. 12, 2014

(54) FALL ARREST BLOCK

(75) Inventors: Oliver Auston, Faversham (GB); Duncan Barrier, Faversham (GB)

(73) Assignee: Checkmate Limited, Sheerness (GB)

( * ) Notice: Subject to any disclaimer, the term of this patent is extended or adjusted under 35 U.S.C. 154(b) by 291 days.

(21) Appl. No.: 12/673,477

(22) PCT Filed: Aug. 11, 2008

(86) PCT No.: PCT/GB2008/002718
§ 371 (c)(1),
(2), (4) Date: Mar. 10, 2010

(87) PCT Pub. No.: WO2009/022122
PCT Pub. Date: Feb. 19, 2009

(65) Prior Publication Data

US 2011/0100766 A1 May 5, 2011

(30) Foreign Application Priority Data

Aug. 13, 2007 (GB) ..... 0715785.2

(51) Int. Cl.
*A62B 35/04* (2006.01)

(52) U.S. Cl.
USPC ..... 182/234; 188/65.1; 242/396.4; 182/231

(58) Field of Classification Search
USPC ..... 182/231–240, 3, 70, 71, 73; 188/65.1; 242/383.4, 396.4
See application file for complete search history.

(56) References Cited

U.S. PATENT DOCUMENTS

| | | | | |
|---|---|---|---|---|
| 1,308,480 | A * | 7/1919 | Caouette | 182/237 |
| 2,943,512 | A * | 7/1960 | Nicolaus | 74/575 |
| 2,990,131 | A * | 6/1961 | Carlsson | 242/381.5 |
| 3,760,910 | A | 9/1973 | Koshihara | |
| 4,088,201 | A * | 5/1978 | MacFarlane | 182/5 |

(Continued)

FOREIGN PATENT DOCUMENTS

| | | |
|---|---|---|
| GB | 2437074 | 10/2007 |
| WO | WO9519203 | 7/1995 |

OTHER PUBLICATIONS

Defintion of "webbing" provided in the NonFinal Action The American Heritage® Dictionary of the English Language, Fourth Edition copyright © 2000 by Houghton Mifflin Company. Updated in 2009. Published by Houghton Mifflin Company. All rights reserved.*

(Continued)

*Primary Examiner* — Daniel Cahn
(74) *Attorney, Agent, or Firm* — Burr & Brown, PLLC

(57) ABSTRACT

A fall arrest block 10 has a spindle on which a length of lifeline 14 is wound. In normal use, the lifeline (preferably webbing) retracts onto and extends from a drum housing 12, as the workman moves towards and away from a secure point to which the housing is attached. In the event of a fall, an inertia mechanism sensitive to acceleration of the spindle operates to lock a locking mechanism to hold the spindle against further rotation. An energy absorbing link 18 is built into the webbing, close to a hook 16 to which the workman is attached. The energy absorbing link 18 includes a section of lifeline that is stretchable, but non-elastic. The locking mechanism includes a toothed ratchet wheel that is engaged by a pawl in order to lock the spindle rotation. The toothed ratchet wheel is part of a unitary body with the spindle.

6 Claims, 10 Drawing Sheets

(56) References Cited

U.S. PATENT DOCUMENTS

| | | | | | |
|---|---|---|---|---|---|
| 4,185,792 | A | * | 1/1980 | Weman | 242/383.4 |
| 4,190,213 | A | * | 2/1980 | Ueda | 242/383.4 |
| 4,228,970 | A | * | 10/1980 | Morinaga | 242/383.5 |
| 4,463,830 | A | * | 8/1984 | Geurtsen | 182/238 |
| 4,480,716 | A | * | 11/1984 | Soubry et al. | 182/233 |
| 4,564,154 | A | * | 1/1986 | Takada | 242/383.4 |
| 4,607,805 | A | * | 8/1986 | Burghardt et al. | 242/383.1 |
| 4,811,912 | A | * | 3/1989 | Takada | 242/382.2 |
| 4,830,309 | A | * | 5/1989 | Koike | 242/383.1 |
| 4,877,110 | A | * | 10/1989 | Wolner | 182/232 |
| 4,941,549 | A | * | 7/1990 | Da-Tan et al. | 182/234 |
| 5,094,405 | A | * | 3/1992 | Brum | 244/1 TD |
| 5,186,289 | A | * | 2/1993 | Wolner et al. | 188/180 |
| 5,343,976 | A | * | 9/1994 | Ostrobrod | 182/4 |
| 5,351,906 | A | * | 10/1994 | Feathers | 242/396.6 |
| 5,447,280 | A | * | 9/1995 | Feathers | 242/381.5 |
| 5,593,105 | A | * | 1/1997 | Schmid et al. | 242/383.4 |
| 5,771,993 | A | * | 6/1998 | Anderson et al. | 182/239 |
| 5,829,548 | A | * | 11/1998 | Ostrobrod | 182/18 |
| 5,899,298 | A | * | 5/1999 | Crouse, Jr. | 182/234 |
| 6,129,302 | A | * | 10/2000 | Horcher | 242/396.1 |
| 6,279,682 | B1 | * | 8/2001 | Feathers | 182/239 |
| 7,025,171 | B2 | * | 4/2006 | Cox | 182/3 |
| 7,237,650 | B2 | * | 7/2007 | Casebolt | 182/231 |
| 7,395,984 | B2 | * | 7/2008 | Szarkowski et al. | 242/384 |
| 2005/0145435 | A1 | | 7/2005 | Choate | |
| 2005/0269153 | A1 | | 12/2005 | Casebolt | |
| 2009/0223744 | A1 | * | 9/2009 | Dowie | 182/234 |
| 2011/0088976 | A1 | * | 4/2011 | Jones et al. | 182/231 |

OTHER PUBLICATIONS

Defintion of "unitary" provided in NonFinal Action The American Heritage® Dictionary of the English Language, Fourth Edition copyright © 2000 by Houghton Mifflin Company. Updated in 2009. Published by Houghton Mifflin Company. All rights reserved.*

* cited by examiner

FALL ARREST BLOCK

BACKGROUND OF THE INVENTION a. Field of the Invention

This invention relates to a fall arrest block for use by a workman working above the ground. The block will be connected to a secure fixed point, and a lifeline wound on the block is connected to a harness worn by the workman, with the lifeline winding up and unwinding under spring control whilst the workman moves around, but locking up and providing a soft landing if the workman falls.

b. Related Art

In the event of a fall, fall arrest blocks conventionally work by switching in a friction brake which slows down the rate at which the lifeline is unwound from a drum, whilst absorbing energy in doing so.

One prior art fall arrest block is disclosed in US patent document 2005/269153 A1. This discloses a fall arrest block that uses a section of lifeline formed from two lengths of line sewn together. If a worker falls, the fall is broken by the ripping apart of these two lengths, which helps to dissipate energy.

One concern with this arrangement is that if the fall is severe enough, the full length of the sewn sections will be torn apart. Although there is a fixed length lifeline in parallel with the torn sections having a length longer than that of the sewn sections when torn apart, a problem arises in that the energy absorbing function ceases as the two sewn sections become fully separated. This document therefore proposes the use of a third section in parallel in the form of an elastic section. This adds to the complexity and bulk of the fall arrest block.

It is therefore an objection of the invention provide a fall arrest block that is compact, both in terms of the lifeline spooling mechanism, as well as with the energy absorbing feature used to controllably arrest the fall of a worker secured to the fall arrest block.

BRIEF SUMMARY OF THE INVENTION

According to the present invention, there is provided a fall arrest block having a lifeline wound on a rotatable spindle and connected between the spindle and a harness attachment point, wherein in the event of a fall, the spindle rotation is locked and kinetic energy of the fall is absorbed by a stretchable and non-elastic energy absorbing section of the lifeline between the spindle and the harness attachment point such that, in use, said energy absorbing section stretches as the energy is absorbed.

Preferably the spindle rotation is locked by an inertia mechanism.

Such a block is particularly suitable for workmen working at a relatively short distance above the ground, as the spindle will lock up instantly, and a falling workman will be halted before reaching the ground. For example, the lifeline may have a maximum length of 3 meters.

The inertia mechanism preferably comprises an inertia weight positioned around the shaft of the spindle, with movement of the weight in a radial direction causing a pawl to engage with a component which in turn introduces a locking arm into a position where it locks the rotation of the spindle. The spindle may be unitary with a toothed ratchet wheel with the locking arm being arranged to engage with the ratchet wheel.

The energy absorbing section of the lifeline may comprises a length of stretchable but non-elastic energy absorbing webbing joined at two points along the length of the lifeline, which is itself substantially non-stretchable and of fixed total length. The points where the webbing is joined have between them a length or section of lifeline having a length greater than the length of energy absorbing webbing. The non-stretchable, fixed length portion of the lifeline is preferably also webbing.

In a preferred embodiment of the invention the energy absorbing section of the lifeline is joined in parallel with a non-energy absorbing section of the lifeline. The non-energy absorbing section is longer than the energy absorbing section to allow the energy absorbing section to stretch in a non-elastic way as energy is absorbed.

The lengths of lifeline and energy absorbing webbing can be compressed into a bundle and secured together by easily rupturable stitches, and secured together by shrink-wrapping.

Also according to the invention, there is provided a fall arrest block having a lifeline wound on a rotatable spindle and connected between the spindle and a harness attachment point, wherein:

- in the event of a fall, the spindle rotation is locked by a locking mechanism;
- the locking mechanism includes a toothed ratchet wheel that is engaged by a pawl in order to lock said spindle rotation; and
- the toothed ratchet wheel and the spindle are a unitary body.

The kinetic energy of the fall is absorbed by an energy absorbing means, which in a preferred embodiment is an energy absorbing section of the lifeline between the spindle and the harness attachment point.

The lifeline is wound on the spindle between a pair of hanger plates that transmit weight on the lifeline to a securing means by which the fall arrest block can be secured to an external strong point.

The securing means may include an aperture through in-contact portions of the hanger plates.

The spindle is preferably rotatable on a first bearing formed by direct contact between said unitary body and a smooth bearing surface extending around an aperture through a hanger plate.

The spindle may also be rotatable on a second bearing that is part of a coil rewind mechanism for automatically rewinding the lifeline.

In a preferred embodiment of the invention, a low friction film is applied to the inner surfaces of the hanger plates to help the lifeline to coil and uncoil evenly and smoothly.

BRIEF DESCRIPTION OF THE SEVERAL VIEWS OF THE DRAWINGS

The invention will now be further described, by way of example only, with reference to the accompanying drawings, in which.

DETAILED DESCRIPTION OF THE INVENTION

Figure 1:
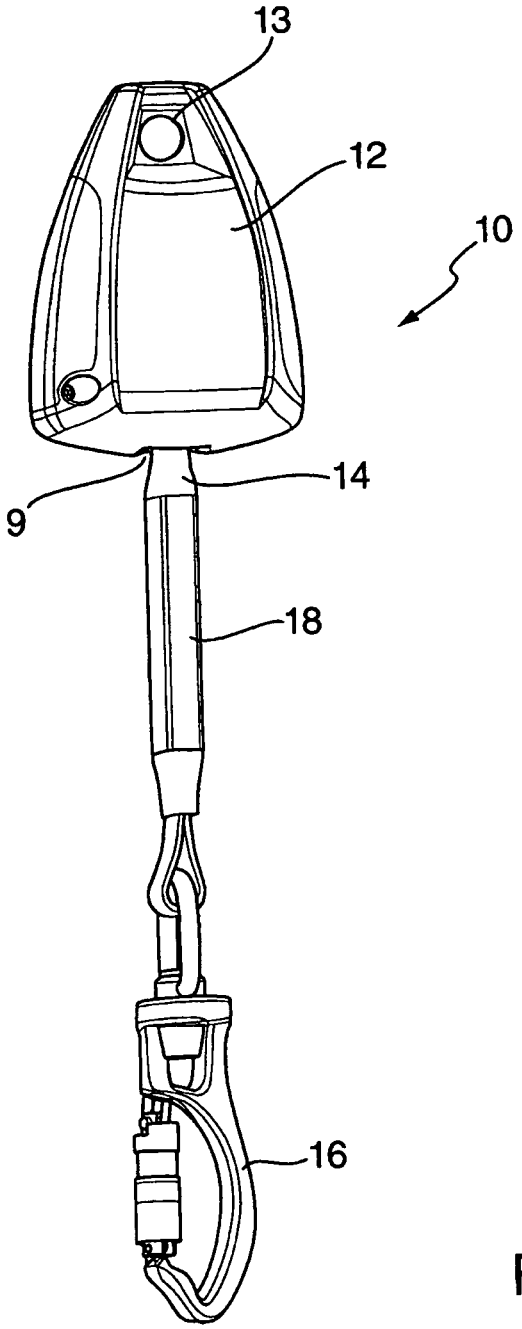
FIG. 1 shows a fall arrest block in accordance with a preferred embodiment of the invention, having a fall arrest block housing that plays out a lifeline which terminates in a hook.

The Figures show a fall arrest block generally designated 10, with a drum housing cover 12, a length of webbing 14 and a hook 16. In use, a workman will attach the drum housing 12 via an aperture 13 that passes through the drum housing to a fixed strong point and the hook 16 to his safety harness. As he moves towards and away from the housing 12 in the course of normal working, a drum of coiled webbing 30 will be withdrawn from the housing 12 through a lower aperture 9 and will wind back onto the drum of coiled webbing 30 under the influence of a spring 40 within the housing 12.

The block 10 is small enough and lightweight enough for it to be easily carried around by a workman, so that it can be directly attached to a strong point wherever the work is taking place.

However, should the workman fall, a drum inertia mechanism 42, which will be described below, will immediately lock up and stop any webbing 14 being withdrawn. It is necessary for there to be energy absorption between the housing and the workman, so that the fall is broken gradually to avoid injury. To achieve this, the webbing adjacent the hook includes an energy absorbing region 18 which is shown in more detail in FIG. 2.

The main load carrying webbing 14 is combined with a shorter length of extensible webbing 20, and the two lengths of webbing are folded up and encapsulated in a shrink-wrap sleeve 22.

Figure 2:
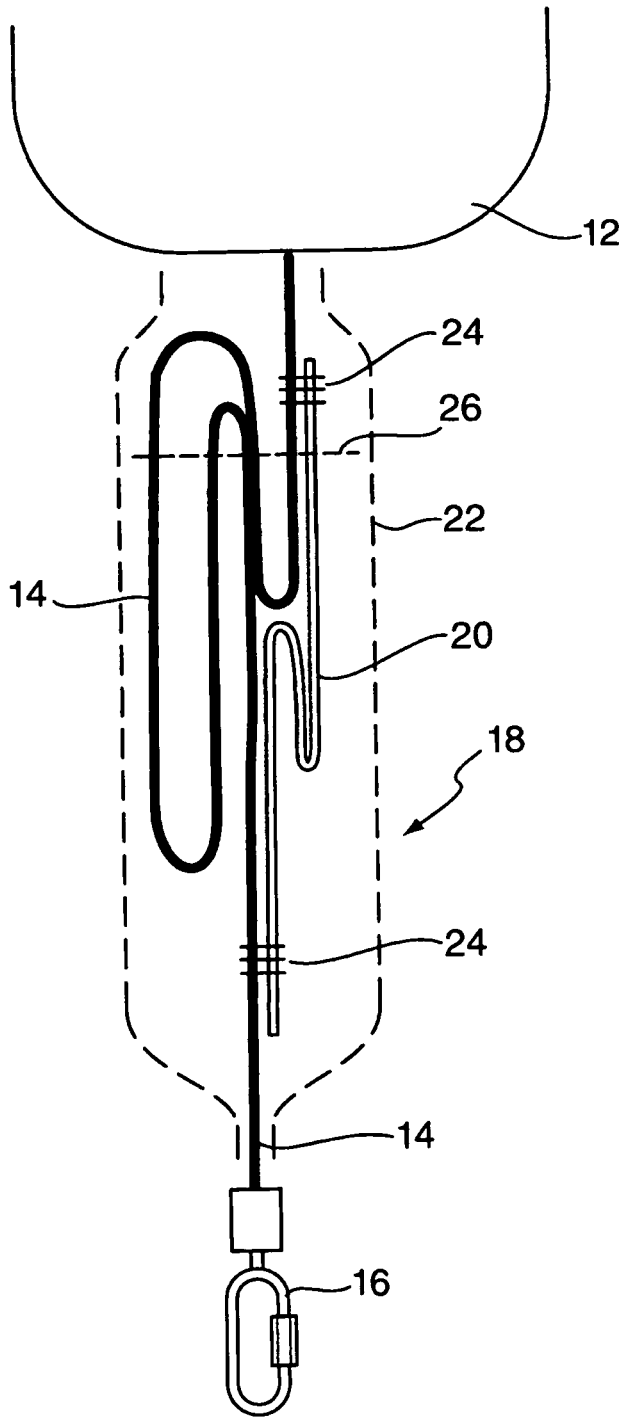
FIG. 2 shows schematically the arrangement of the lifeline between the fall arrest block housing and the hook.
Figure 3:
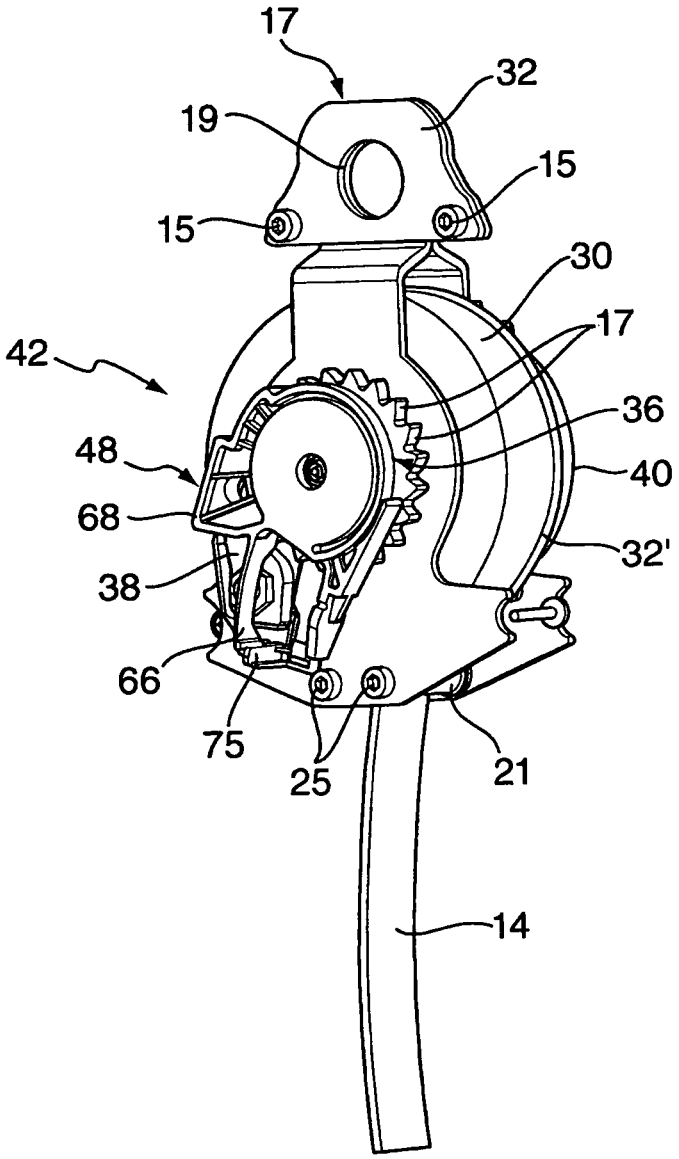
FIG. 3 shows a front perspective view of internal components of the fall arrest block housing of FIG. 1 after an external drum housing cover has been removed to reveal a coiled drum of webbing lifeline and an inertia activation mechanism for locking the rotation of the coiled drum.

As will be seen from FIG. 2, the length of the main webbing 14 within the sleeve 22 is longer than that of the extensible webbing 20. The two lengths are sewn to each other at both ends, at 24, and are tacked together by a rupturable stitch at 26. When a large load comes on the webbing as will happen in the case of a fall, the shrink wrap will fail as this has no tensile strength. Then the stitch 26 will fail, so that the extensible webbing 20 takes the load. This webbing is constructed of a loose weave and gradually extends, absorbing energy the while. Finally, this webbing will stretch to the same length as that of the webbing 14, and at that point, all the load will be taken by the webbing 14.

Within the drum housing 12, the drum of coiled webbing 30 is mounted for rotation between a pair of galvanised steel hanger plates 32, 32'. One end of the webbing (not shown) is securely fixed to the spindle 34 at a slot 35 which extends through a mid plane of the spindle. Although not illustrated, one way to make sure that the webbing cannot come free of the slot 35 is to sew the end of the webbing back on itself to form a loop that wraps around a metal pin or wedge that has a diameter too large to pass through the slot 35. The slot extends to a free end 39 of the spindle so that during assembly of the block 10, the loop and pin can be inserted into the slot 35. The webbing is then wrapped in a spiral around a spindle 34 and on previous wraps of webbing to form the coiled drum of webbing 30.

Figure 5:
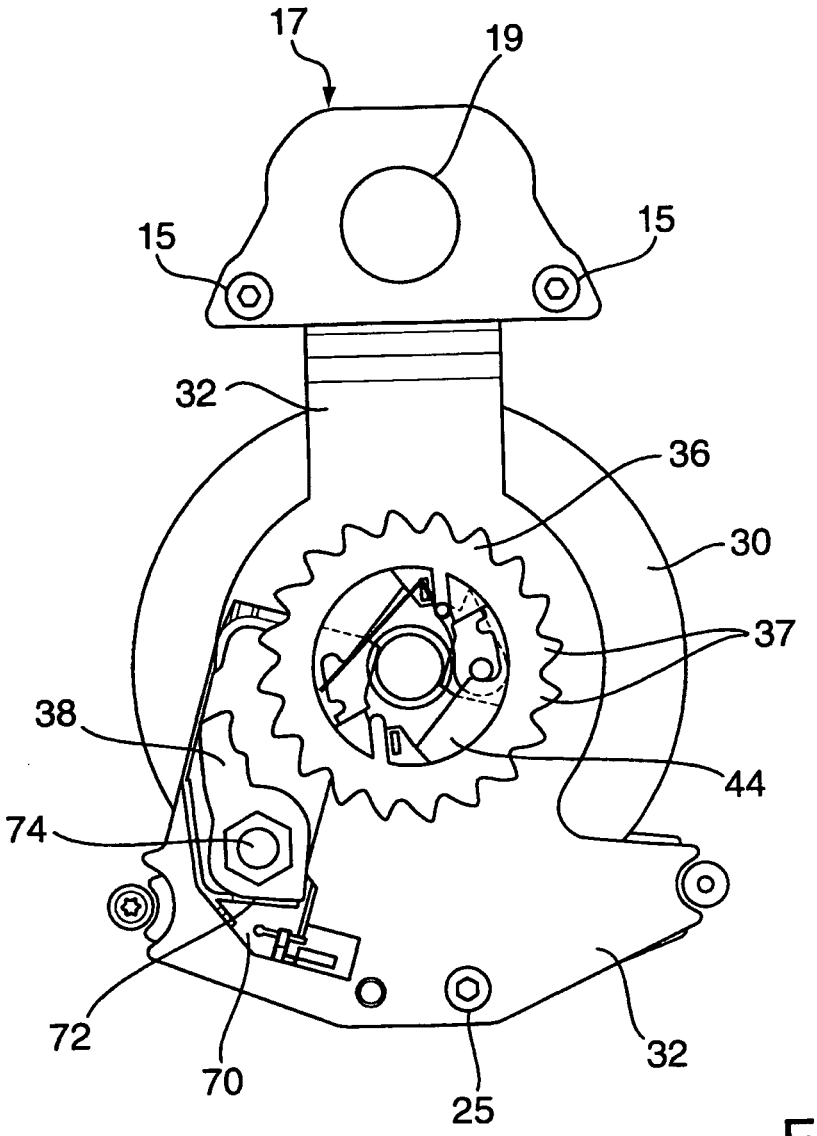
FIG. 5 is a front view of some of the internal components of the fall arrest block housing of FIG. 3, with an outer cap removed from the inertia activation mechanism to show a toothed ratchet wheel and a first pawl for stopping the rotation of the wheel.

The rotation of the spindle 34 drives a toothed ratchet wheel 36. The spindle 34 is separated from the ratchet wheel 36 by a cylindrical step 29 having a diameter intermediate that of the spindle and ratchet wheel. The spindle 34, cylindrical step 29 and ratchet wheel 36 are formed in a unitary machined casting of high tensile brass. The spindle 34 and ratchet wheel 36 are therefore formed as one piece. As shown in FIG. 5, a first pawl 38 (also referred to herein as a "locking arm"), which may be formed in steel or brass, is pivotably mounted on a first one of the hanger plates 32 by means of a steel shaft 74 that extends away from the plate. The locking arm 38 is arranged so that it can engage with ratchet wheel teeth 37 extending around the circumference of the ratchet wheel 36 to stop rotation of the drum of coiled webbing 30. Under normal conditions however, the locking arm 38 is biased away from the ratchet wheel teeth 37.

On the side of the drum of coiled webbing 30 remote from the ratchet wheel 36, there is a coil spring 40, secured to a second one of the hanger plates 32'. The spring 40 rewinds the webbing 14 onto the spindle 34 and drum of coiled webbing 30 when there is no tension in the webbing that has been played out.

The hanger plates 32, 32' are generally parallel with each other either side of the coiled drum of webbing 30, and are joined at a top end by means of a pair of bolts/nuts 15, 15' where the plates converge to come into contact with each other along a median plane of the drum of coiled webbing 30 to form a hanging section 17 that has a through aperture 19 which is in alignment with the aperture 13 in the drum housing 12.

The bottom end of the hanger plates 32, 32' are held securely in a spaced apart parallel relationship by means of a pair of hollow posts 21 that are engaged with a corresponding pair of bolts/nuts 25, 25'.

Figure 4:
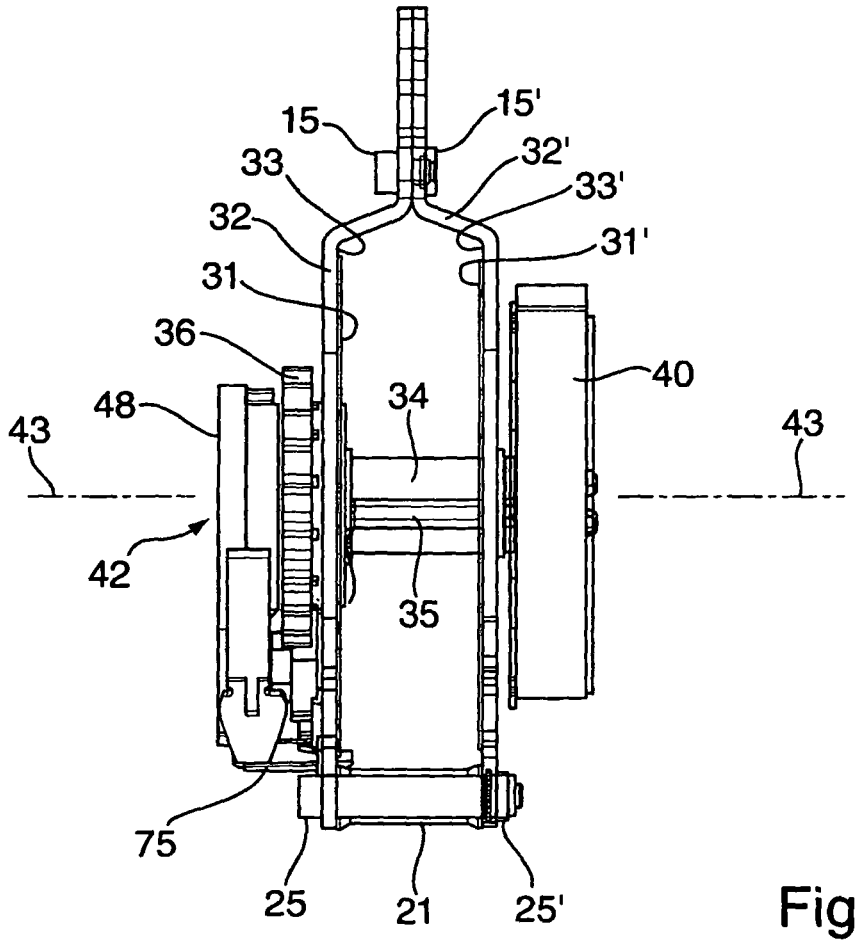
FIG. 4 is a side view of some of the internal components of the fall arrest block housing of FIG. 3, with the coiled drum of lifeline removed and showing how a pair of hanger plates support opposite ends of a spindle, and on opposite sides of the plates a tensioning coil spring and the inertia activation mechanism.

Smooth and even winding and unwinding of the webbing 14 around the spindle 34 is ensured by a pair of low friction annular pads 31, 31' (FIG. 4) that are affixed by means of a contact adhesive (not shown) to corresponding parallel inner surfaces 33, 33' of the pair of hanger plates 32, 32'.

The spindle 34 passes through a pair of circular apertures 27, 27', one in each of the hanger plates 32, 32'

Figure 10:
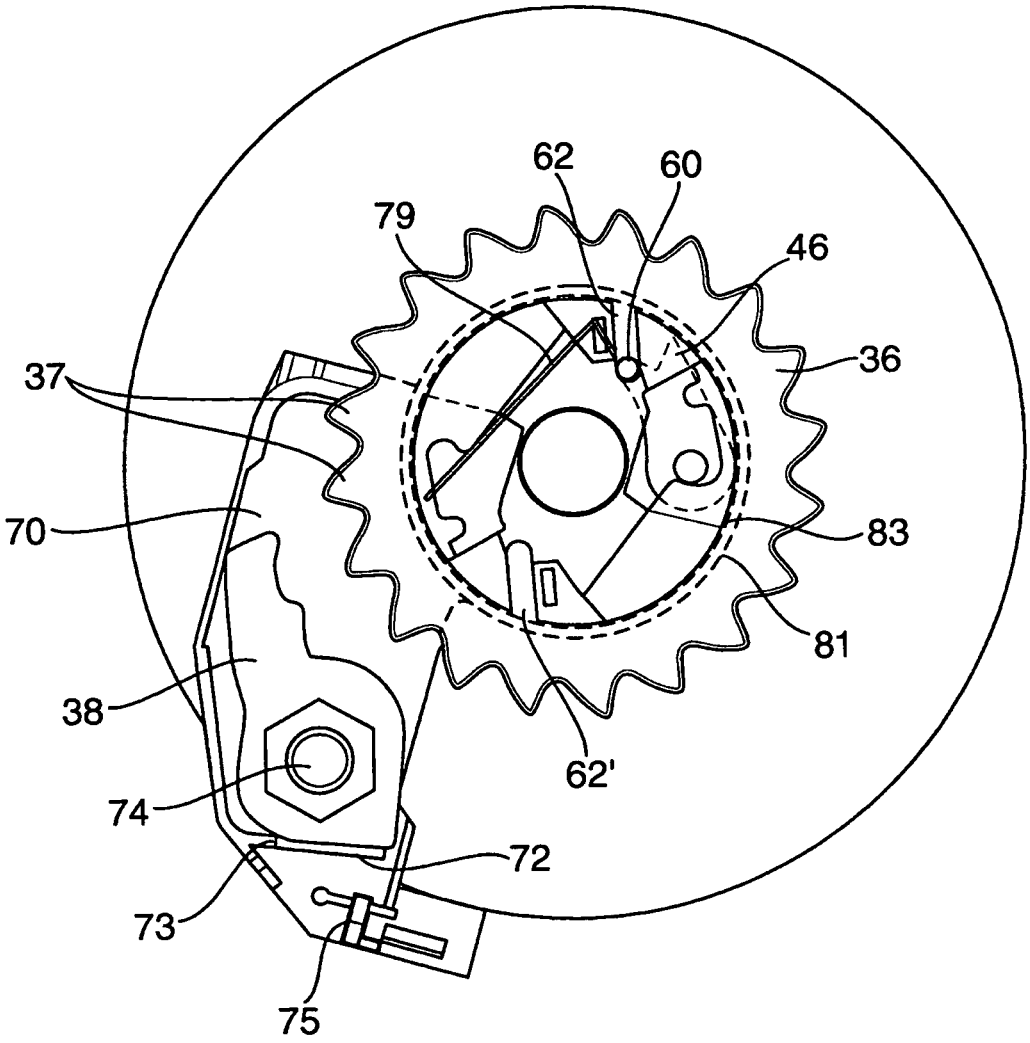
FIG. 10 is a view from the opposite side to FIG. 9, with the outer cap removed.

As shown in FIG. 10, the plastic base 70 has a cylindrical sleeve 81 that inserts snugly into the hanger plate aperture 27. An inner surface 83 of the sleeve is sized to provide a close sliding fit with the cylindrical step 29 between the spindle 34 and the ratchet wheel 36 to provide a smooth, low friction bearing surface for the rotation of the unitary body in which the spindle, step and ratchet wheel are formed. The plastic base is therefore formed from a low friction plastic material, for example nylon.

The choice of materials, high tensile brass on the one hand, and a smooth low friction plastic material on the other, provides a reliable bearing having a smooth rotational movement without the need for any lubricants or other bearing components.

The free end of the spindle 39 terminates in a pair of prongs 11 that engage with the coil spring mechanism 40, which therefore also provides rotational support at this end of the spindle.

The inertia mechanism 42 is used to trigger movement of the locking arm 38 into engagement with the ratchet wheel teeth 37 to lock the spindle 34 and drum of coiled webbing 30 against rotation. This inertia mechanism is indicated generally at 42, and operates in a manner similar to that of a vehicle seatbelt mechanism. The inertia mechanism 42 is sensitive to acceleration of the drum rather than the speed of the drum, which means that it responds very quickly to a fall.

The inertia mechanism 42 has three main parts, namely an inertia weight 44, a second pawl 46 and an outer cap 48 a central portion of which has the general form of a cup 41 that faces towards the ratchet wheel 36. When the drum rotation accelerates, the inertia weight 44 moves to cause the second pawl 46 to move outwards into engagement with cup rim ratchet teeth 64 that extend inwardly around the inside rim 47 of the cup 41. The outer cap 48 therefore serves firstly as a locking cup to lock the rotation of the spindle 34 and ratchet wheel 36 to the outer cap 48. This causes the outer cap 48 to rotate to urge the locking arm 38 against the ratchet wheel teeth 37.

Figure 7:
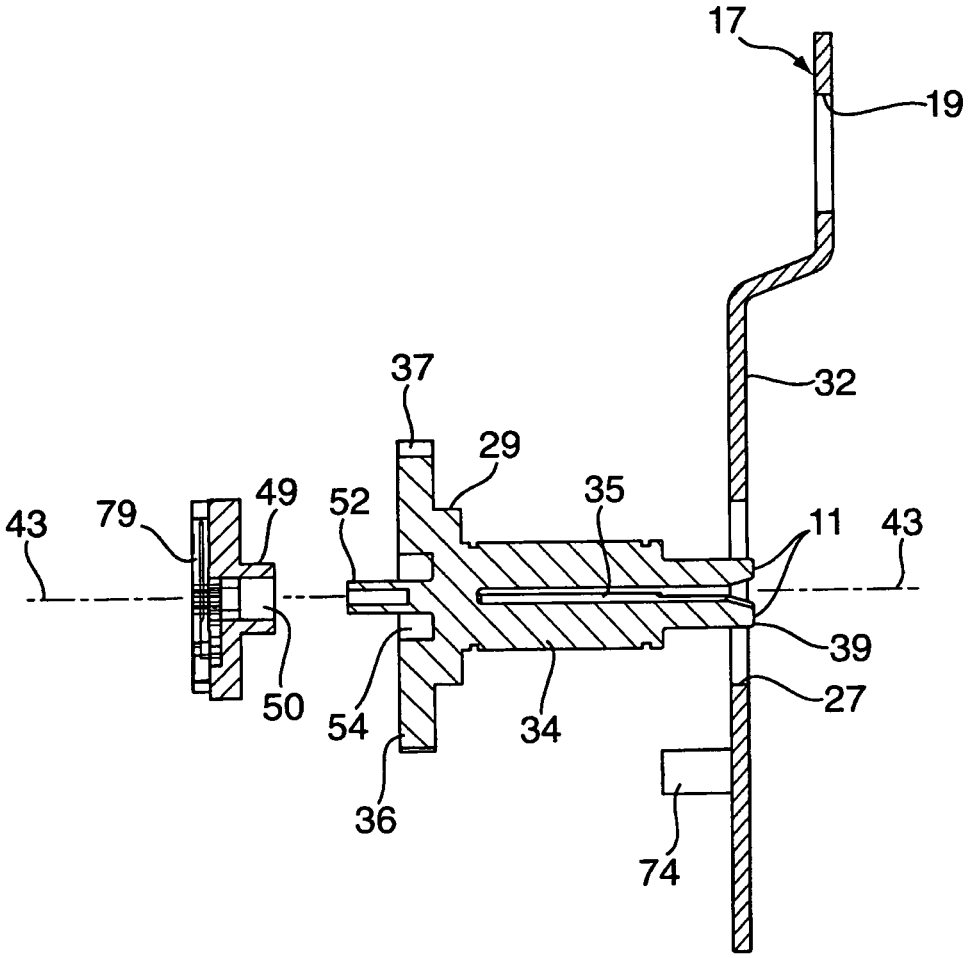
FIG. 7 is a cross-section through the inertia weight and the ratchet wheel, showing how the wheel is unitary with the spindle.

The inertia weight 44 is a generally circular or disc-shaped metal component with a boss 49, and a central bore 50 (FIG. 7) that extends fully through the component along the rotational axis 43. The cup 41 has a base plate 45 that extends between the rim 47 and a central hollow cylindrical post 51. The post 51 has a smooth outer surface 53 and a central bore 55 that extends through the base plate 45.

The bore 50 of the inertia weight 44 fits loosely over the outer surface 53 of the post 51 such that the weight would be free to rotate, in the absence of any other constraints, with respect to the cup 41. A central mounting post 52 that is coaxial with the spindle 34, but on the opposite side of the ratchet wheel 36, extends towards the boss 49 and cup 41 and is received in the bore 55 of the cup to locate the cup and the rest of the outer cap 48 with respect to an axis 43 of the spindle 34. The fit between the central mounting post 52 and the bore 55 is loose so that the ratchet wheel 36 is free to rotate with respect to the outer cap 48. The assembly of the inertia mechanism is completed by a rivet 77 that engages with a bore 78 in the central mounting post 52.

The central mounting post 52 is surrounded by a recess 54 in the ratchet wheel, which receives the annular wall of the boss. The internal and external diameters of the cup 48, the boss 49, the central mounting post 52 and the recess 54 are such that the inertia weight 44 is a loose fit on the post 51 with clearance between, on the one hand, the inertia weight and, on the other hand, the cup rim 47, the cup base plate 45 and the ratchet wheel 36 so that the inertia weight may move freely.

Figure 8:
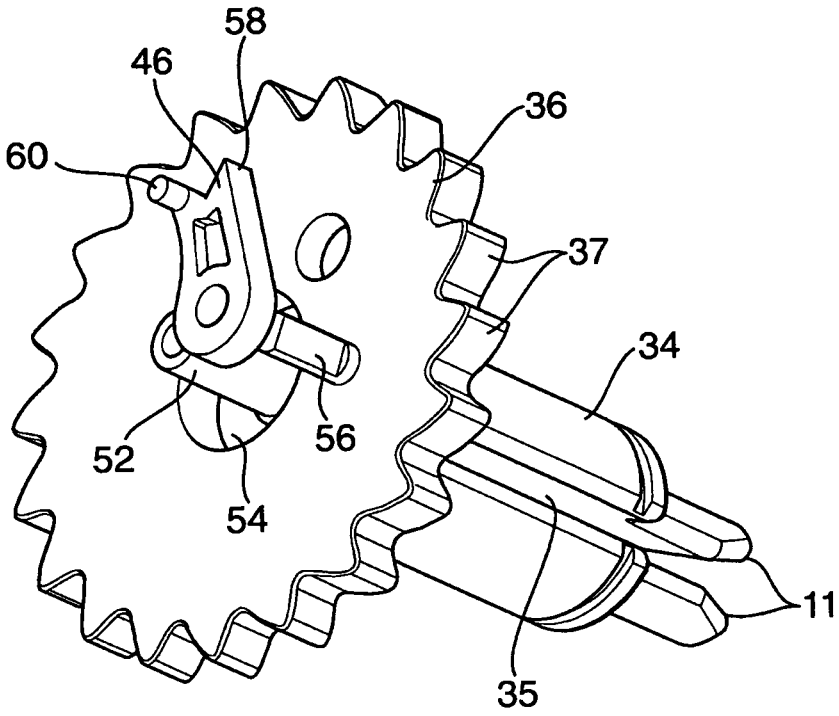
FIG. 8 shows the ratchet wheel, spindle and a second pawl, in an exploded perspective view.

The second pawl 46 (FIG. 8) fits over a pin 56 which is an integral part of the ratchet wheel 36. The second pawl has a tooth 58 that extends in a substantially radial direction, and a first projection 60 that extends transversely to the tooth 58 in a direction parallel with the rotational axis 43 of the spindle 34. When the mechanism is assembled, the projection 60 lies in a track 62 within the inertia weight 44. The second pawl also has a second projection 60' that is coaxial with the first projection, but extending in an opposite direction from an opposite side of the second pawl.

Under normal conditions, the tooth 58 does not project beyond the diameter of the inertia weight 44, and is kept in that position by a light spring 79 which engages with the second projection 60' to bias the second pawl 46 towards the axis 43 of the spindle 34.

When the spindle 34 experiences sudden angular acceleration, such that static friction between the post surface 53 and weight bore 50 is insufficient to impart an equivalent angular acceleration in the weight 44, the inertia of the weight 44 will cause the rotational movement of the weight 44 to lag that of the spindle 34. As a result, the weight moves rotationally with respect to the spindle 34 and ratchet wheel 36.

As a result, the projection 60 of the second pawl 46 will move along the track 62 in the weight 44, thereby causing the tooth 58 to come into engagement with the cup rim ratchet teeth 64 on the inside of the cup 41. When that happens, the cup 41 and the spindle 34 will be locked together for rotation causing the cup 41 and the rest of the outer cap 48 to rotate. The rotation of the outer cap 48 will then bias the locking arm 38 against the ratchet wheel teeth 37, to lock the drum of coiled webbing 30.

Figure 6:
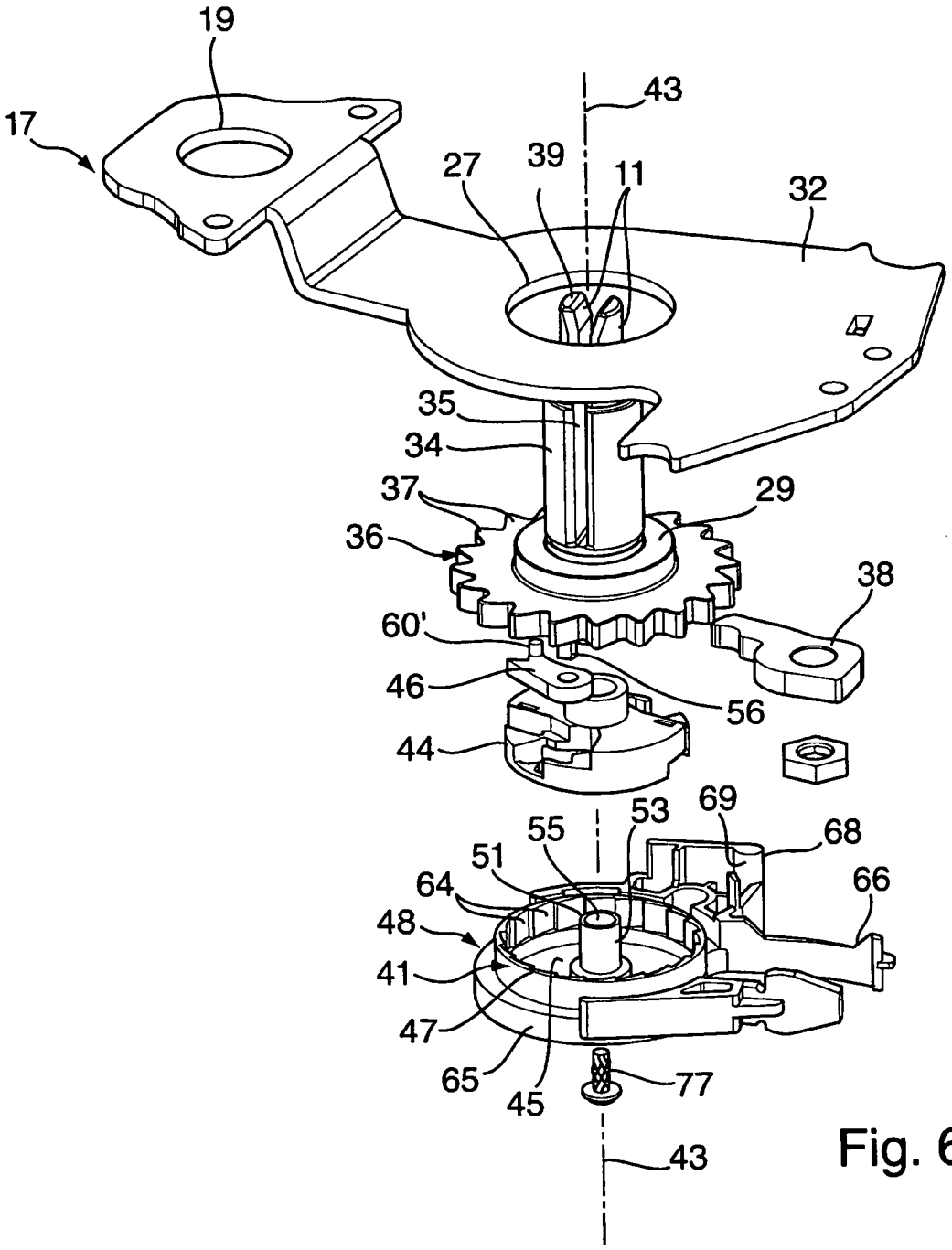
FIG. 6 is an exploded perspective view of the inertia activation mechanism, showing the outer cap, an inertia weight and the ratchet wheel.
Figure 9:
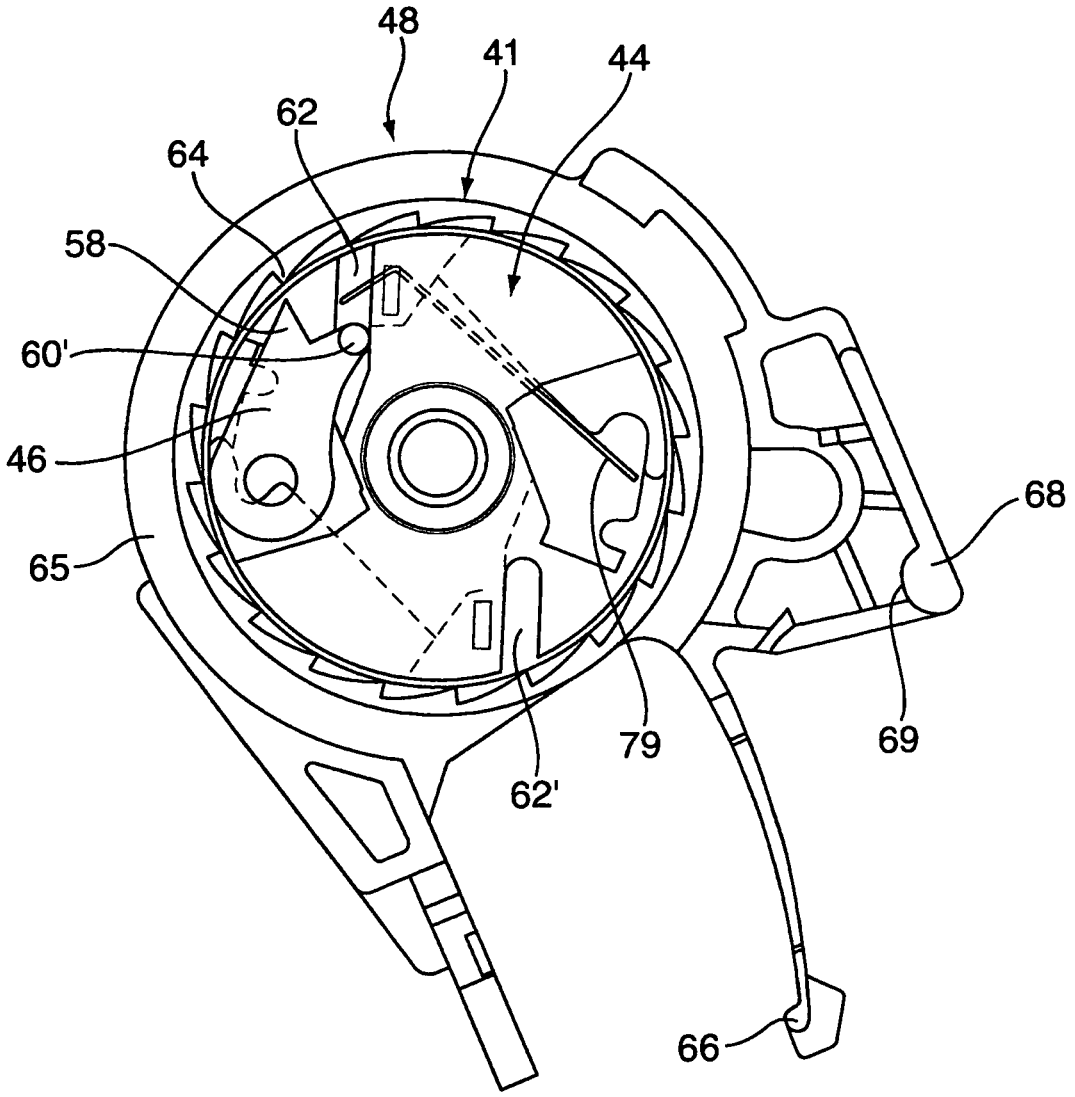
FIG. 9 is a plan view looking into a locking cup portion of the outer cap.

The cup 48 is a plastic component. Once the drum of coiled webbing 30 is locked, the cup carries no load. As shown in FIGS. 6 and 9, the outer cap 48 has around most of the outer periphery of the cup 41 an annular reinforcing structure 65 which stabilises and provides strength to the cup rim 47. The reinforcing structure 65 also supports a first arm 66 that extends outwards in an approximately radial direction. The arm 66 reacts against an abutment 75 that extends in a direction parallel with the rotation axis 43 from the plastic base 70 that is fixed on the on the first hanger plate 32 to return the outer cap 48 to its normal position. The reinforcing structure 65 also supports a second arm 68, an inner bearing surface 69 of which pushes the locking arm 38 into contact with the ratchet wheel teeth 37 when the outer cap 48 is caused to rotate by the engagement of the second pawl 46 with the cup rim ratchet teeth 64.

A plastic base 70 (FIGS. 5 and 10) fixed on the first hanger plate 32 has a resilient flap 72 fixed at one end 73 to the remainder of the base 70 which normally biases the pivoting locking arm 38 away from the ratchet wheel 36.

The inertia weight 44 is of complex shape. It has recesses for accommodating the light spring to bias the second pawl 46, and the angled track 62 is duplicated 62' in a diametrically opposite position so that the weight is rotationally balanced.

In summary, the fall arrest block 10 has the spindle 34 on which a length of lifeline, which is preferably the webbing 14, is wound. In normal use, the lifeline retracts onto and extends from the drum housing 12, as the workman moves towards and away from a secure point to which the housing is attached. In the event of a fall, the inertia mechanism 42 sensitive to acceleration of the spindle 34 operates to lock a locking mechanism to hold the spindle 34 against further rotation. An energy absorbing link 18 is built into the webbing, proximate to the hook 16 to which the workman is attached. The energy absorbing link 18 includes a section of lifeline (the extensible webbing 20) that is stretchable, but non-elastic. The locking mechanism includes the toothed ratchet wheel 36 that is engaged by the first pawl 38 in order to lock the spindle rotation. The toothed ratchet wheel 36 is part of a unitary body with the step 29 and spindle 34.

The arrangement described above, in which an inertia trigger is used to lock up the spindle 34 and drum of coiled webbing 30 to halt paying out of webbing 14, serves to stop the movement of the drum of webbing very quickly. This is particularly important when the block is used by people working at relatively low heights above the ground, so that they do not hit the ground before the block has time to arrest their fall.

The drum housing 12 is quite compact, measuring in total 147 mm along a vertical direction (from above the securing aperture 13 to the lower aperture 9), 112 mm in width, and just 80 mm in thickness along the direction of the rotational axis 43.

The arrangement described above also provides a fall arrest block 10 that is compact in the axial dimension, that is, the dimension parallel with the rotational axis 43 of the spindle 34. This compact form makes it easier for a user to carry and to fix to secure points. This is a particular benefit when working in exposed locations or areas with restricted access. Features of the apparatus which contribute to reducing the thickness of the block include the use of two steel hanger plates.

Because the spindle 34, step 29 and ratchet wheel 36 are formed as a unitary piece, there is no need for any additional components to join or fix these parts together and this again helps to reduce the dimensions of these parts in an axial direction.

The choice of materials, high tensile brass for the spindle 34 and ratchet wheel 36, and a plastic bushing inside an aperture in a steel hanger plate, provides a reliable and long lasting bearing having a smooth rotational movement without the need for any lubricants or other bearing components. This also helps to minimise the dimensions of the assembly in the axial direction.

The use of the coil spring mechanism 40 to provide rotational support at the free end 39 of the spindle 34 eliminates the need for any other bearing components between the spindle and the rear hanger plate 32', which again simplifies construction and helps to minimise the width of the assembly in the axial direction.

The arrangement described above also does not need to employ rotatable flanges fixed to the spindle. This is because the parallel separation and smooth inner profile of the hanger plates, aided by the use of a low friction film applied to the inner surfaces of the hanger plates. Avoiding the need for rotatable flanges also helps to keep the axial dimensions of the apparatus to a minimum.

Further advantages are provided by avoiding the need for a complicated bearing between the spindle and hanger plates. As the bearing is either provided within the overall thickness of the first hanger plate, or outside the second hanger plate within the rewind spring mechanism, bearings to not impinge on the space between the hanger plates, which can therefore be spaced apart with the minimum separation required to ensure smooth running of the lifeline as this is played out or wound in. This also helps to keep the axial dimensions of the apparatus to a minimum.

The invention therefore provides a convenient and compact fall arrest block for use by a workman working above the ground.

The invention claimed is:

1. A fall arrest device for protecting a worker from falling at a height, the fall arrest device comprising:

a rotatable spindle;

a lifeline, the lifeline including a harness attachment point for connection to said worker, the lifeline being wound on the spindle such that the lifeline is connected between the spindle and said harness attachment point whereby the spindle is capable of rotating to wind the lifeline onto the spindle as said worker moves towards the spindle and the spindle is capable of rotating to unwind the lifeline from the spindle as said worker moves away from the spindle;

a locking mechanism for locking said spindle from rotation from said unwinding of the lifeline, the locking mechanism including a toothed ratchet wheel and a first pawl, the toothed ratchet wheel having teeth that extend outwardly around the toothed ratchet wheel; and an inertia mechanism comprising a second pawl and a ratcheted cap for triggering said locking of the locking mechanism, the inertia mechanism being sensitive to rotational acceleration of the spindle from said unwinding of the lifeline, whereby the rotational acceleration is capable of moving the second pawl into engagement with the ratcheted cap to urge the first pawl into engagement with said ratchet wheel teeth to lock said spindle from rotation from said unwinding of the lifeline when said unwinding is caused by a falling worker connected to the lifeline at the harness attachment point;

a pair of hanger plates; and a securing means for securing the fall arrest device to an external point, wherein:

the lifeline is wound on the spindle between said pair of hanger plates; said hanger plates, when in use, transmitting weight on the lifeline to said securing means for securing the fall arrest device to the external point; and a first hanger plate of said pair of hanger plates has an inner surface that is parallel to an inner surface of a second hanger plate of said pair of hanger plates, the fall arrest device further comprising a pair of annular pads, each respective one of said hanger plates having a respective one of said pair of annular pads affixed to the corresponding inner surface of said respective hanger plate;

the inertia mechanism is mounted on a mounting post;

the mounting post is coaxial with the spindle;

the spindle extends from one side of the toothed ratchet wheel and the mounting post extends from an opposite side of the toothed ratchet wheel; and the toothed ratchet wheel, the spindle and the mounting post are formed as a unitary body of one-piece construction.

2. The fall arrest device as claimed in claim 1, in which a portion of the first hanger plate of said pair of hanger plates is in contact with a portion of the second hanger plate of said pair of hanger plates, each of said portions of said hanger plates having an aperture that extends through each of said portions of said hanger plates in contact with each other, wherein the securing means for securing the fall arrest device to the external point includes said aperture.

3. The fall arrest device as claimed in claim 1, in which the mounting post is surrounded by an annular recess in the toothed ratchet wheel.

4. The fall arrest device as recited in claim 1, wherein said unwinding of the lifeline is stopped when the first pawl moves into engagement with said ratchet wheel teeth to lock said spindle from rotation.

5. A fall arrest device for protecting a worker from falling at a height, the fall arrest device comprising:

a rotatable spindle;

a lifeline, the lifeline including a harness attachment point for connection to said worker, the lifeline being wound on the spindle such that the lifeline is connected between the spindle and said harness attachment point whereby the spindle is capable of rotating to wind the lifeline onto the spindle as said worker moves towards the spindle and the spindle is capable of rotating to unwind the lifeline from the spindle as said worker moves away from the spindle;

a locking mechanism for locking said spindle from rotation from said unwinding of the lifeline, the locking mechanism including a toothed ratchet wheel and a first pawl, the toothed ratchet wheel having teeth that extend outwardly around the toothed ratchet wheel; and an inertia mechanism comprising a second pawl and a ratcheted cap for triggering said locking of the locking mechanism, the inertia mechanism being sensitive to rotational acceleration of the spindle from said unwinding of the lifeline, whereby the rotational acceleration is capable of moving the second pawl into engagement with the ratcheted cap to urge the first pawl into engagement with said ratchet wheel teeth to lock said spindle from rotation from said unwinding of the lifeline when said unwinding is caused by a falling worker connected to the lifeline at the harness attachment point, wherein:

the inertia mechanism is mounted on a mounting post;

the mounting post is coaxial with the spindle;

the mounting post is surrounded by an annular recess in the toothed ratchet wheel;

the spindle extends from one side of the toothed ratchet wheel and the mounting post extends from an opposite side of the toothed ratchet wheel; and the toothed ratchet wheel, the spindle and the mounting post are formed as a unitary body of one-piece construction.

6. A fall arrest device for protecting a worker from falling at a height, the fall arrest device comprising:

a rotatable spindle;

a lifeline, the lifeline including a harness attachment point for connection to said worker, the lifeline being wound on the spindle such that the lifeline is connected between the spindle and said harness attachment point whereby the spindle is capable of rotating to wind the lifeline onto the spindle as said worker moves towards the spindle and the spindle is capable of rotating to unwind the lifeline from the spindle as said worker moves away from the spindle;

a locking mechanism for locking said spindle from rotation from said unwinding of the lifeline, the locking mechanism including a toothed ratchet wheel and a first pawl, the toothed ratchet wheel having teeth that extend outwardly around the toothed ratchet wheel, wherein the ratchet wheel, the spindle and a cylindrical step form a unitary body of one-piece construction;

an inertia mechanism comprising a second pawl and a ratcheted cap for triggering said locking of the locking mechanism, the inertia mechanism being sensitive to rotational acceleration of the spindle from said unwinding of the lifeline, whereby the rotational acceleration is capable of moving the second pawl into engagement with the ratcheted cap to urge the first pawl into engagement with said ratchet wheel teeth to lock said spindle from rotation from said unwinding of the lifeline when said unwinding is caused by a falling worker connected to the lifeline at the harness attachment point; and a cylindrical sleeve, wherein:

the spindle is rotatable on a bearing formed by direct contact between the cylindrical step of said unitary body and a bearing surface of the cylindrical sleeve extending around an aperture through a hanger plate;

the spindle has a first diameter;

the ratchet wheel has a second diameter, the second diameter is greater than the first diameter;

the spindle is separated from the ratchet wheel by the cylindrical step, the cylindrical step having a diameter intermediate that of the first diameter and the second diameter.

* * * * *